US010310541B2

(12) United States Patent
Gur et al.

(10) Patent No.: US 10,310,541 B2
(45) Date of Patent: Jun. 4, 2019

(54) ILLUMINATED ROTARY KNOB FOR HOUSEHOLD APPLIANCE

(71) Applicant: ARCELIK ANONIM SIRKETI, Istanbul (TR)

(72) Inventors: Metin Gur, Istanbul (TR); Abdurrahman Sahin, Istanbul (TR); Fatih Ceylan, Istanbul (TR); Ugur Camli, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 0 days.

(21) Appl. No.: 15/750,197

(22) PCT Filed: Aug. 6, 2015

(86) PCT No.: PCT/EP2015/068173
§ 371 (c)(1),
(2) Date: Feb. 4, 2018

(87) PCT Pub. No.: WO2017/020963
PCT Pub. Date: Feb. 9, 2017

(65) Prior Publication Data

US 2018/0232001 A1 Aug. 16, 2018

(51) Int. Cl.
*G05G 1/10* (2006.01)
*H01H 9/16* (2006.01)
(Continued)

(52) U.S. Cl.
CPC ..... *G05G 1/105* (2013.01); *F24C 7/082* (2013.01); *H01H 9/161* (2013.01);
(Continued)

(58) Field of Classification Search
CPC ..... G05G 1/015; G05G 1/08; G05G 1/082; G05G 1/10; G05G 1/105;
(Continued)

(56) References Cited

U.S. PATENT DOCUMENTS 6,003,206 A * 12/1999 Hall ..... G05G 1/105 16/433
7,195,363 B2 * 3/2007 Horoho ..... G01D 11/28 362/23.21
(Continued)

FOREIGN PATENT DOCUMENTS

DE 10218294 A1 11/2003
DE 10236935 A1 2/2004
(Continued)

OTHER PUBLICATIONS

International search report and written opinion, dated Mar. 23, 2016, of International Application No. PCT/EP2015/068173; 11 pgs.

*Primary Examiner* — Prasad V Gokhale
(74) *Attorney, Agent, or Firm* — Kilpatrick Townsend & Stockton LLP

(57) ABSTRACT

The present invention relates to an illuminated releasable rotary knob for use in an appliance, in particular in a cooking appliance comprising a panel which includes a regulator shaft; and a control unit which has an electrical connection for supplying electric power. The knob comprises non-transparent handle, a hub for releasably receiving the shaft, a cavity, an illuminating device for illuminating the cavity, a connector for receiving the electrical connection and a transparent indicator which receives the illumination from the cavity.

15 Claims, 4 Drawing Sheets

Figure 1:
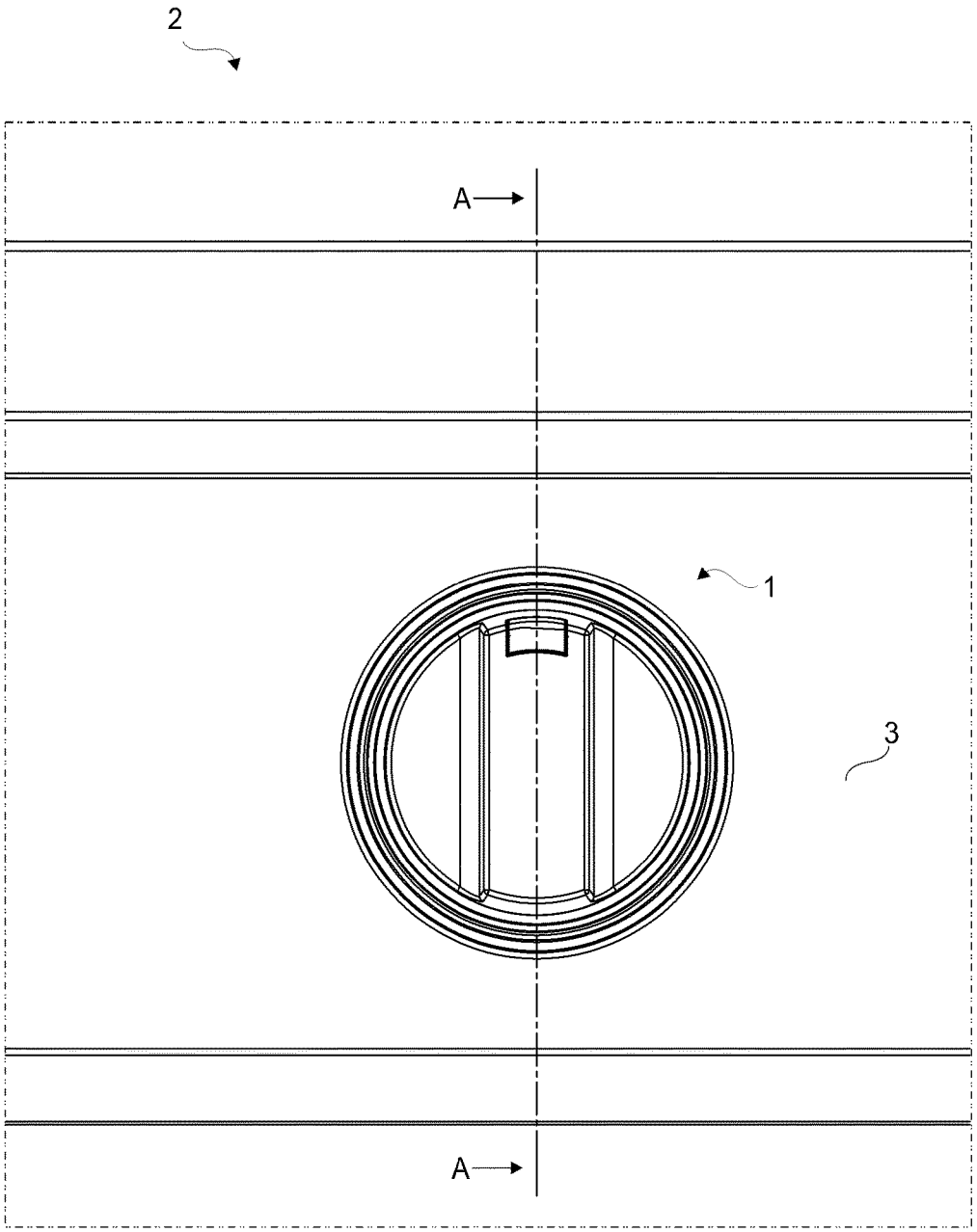

(51) Int. Cl.
*F24C 7/08* (2006.01)
*H01H 19/02* (2006.01)
*H01H 19/14* (2006.01)

(52) U.S. Cl.
CPC ..... *H01H 19/025* (2013.01); *H01H 19/14* (2013.01); *H01H 2009/164* (2013.01)

(58) Field of Classification Search
CPC ..... G05G 2009/04748; F24C 3/126; F24C 7/082; H01H 19/025; H01H 19/14; H01H 2009/164; H01H 9/161
See application file for complete search history.

(56) References Cited

U.S. PATENT DOCUMENTS

| | | | | |
|---|---|---|---|---|
| 2004/0070574 | A1* | 4/2004 | Wylie | F24C 7/082 345/184 |
| 2005/0064808 | A1* | 3/2005 | Ogawa | B60H 1/0065 454/69 |
| 2007/0103884 | A1* | 5/2007 | Popowich | H01H 19/025 362/23.21 |
| 2016/0320040 | A1* | 11/2016 | Kang | H05B 33/0842 |
| 2017/0250037 | A1* | 8/2017 | Tanaka | B60R 16/02 |
| 2018/0003392 | A1* | 1/2018 | Babu | F24C 7/088 |

FOREIGN PATENT DOCUMENTS

| | | | |
|---|---|---|---|
| DE | 102009042562 | A1 | 12/2010 |
| EP | 2701031 | A2 | 2/2014 |

* cited by examiner

ILLUMINATED ROTARY KNOB FOR HOUSEHOLD APPLIANCE

RELATED APPLICATIONS

This application is a U.S. National Phase of International Application No. PCT/EP2015/068173, filed Aug. 6, 2015, the entire disclosure of which is incorporated by reference herein.

The present invention relates to an illuminated releasable rotary knob for use in a household appliance, in particular in a cooking appliance.

Household appliances in particular gas/electric cooking appliances are commonly known in the art. A cooking appliance generally includes a heating unit for cooking the food. The heating units commonly include gas burners and/or electrical resistance heaters. The heating units are commonly arranged onto the cooking top and/or into the cooking chamber of the appliance. The heating level of the respective heating unit is commonly adjusted by a respective rotary knob which is disposed on the panel of the appliance and releasably connected to the regulator shaft of the respective heating unit. In order to improve the user convenience the rotary knob is commonly provided with an illuminated indicator. The user manipulates the illuminated rotary knob in order to turn the appliance on or off, and to regulate the heating level of the respective heating unit. The user can recognize the operative state of the heating unit through the position of respective illuminated indicator.

US 2007/0103884 A1 Discloses a Rotary Knob with an Illuminated Indicator.

A common problem with the prior art cooking appliances is that the user cannot always reliably ascertain the current operative state of the heating units by means of the illuminated indicator as there is generally a risk that the illuminated indicator escapes from the eye of the user, for instance, when the user stays at a particularly unfavorable position and/or the surface of the illuminated indicator is heavily soiled. In such instances there is a risk of fire and explosion when the user leaves the appliance unattended for too long. Another common problem with the prior art cooking appliances is that the service person cannot easily service the illuminated releasable rotary knob when the illumination device or any other part thereof is malfunctioning.

An objective of the present invention is to provide an illuminated releasable rotary knob for use in a household appliance which solves the aforementioned problems of the prior art in a cost effective way and which enables the user to operate the household appliance more reliably and safely and which also enables the service person to easily perform the maintenance. Another objective of the present invention is to provide a more reliable and safe method for controlling one or more rotary knobs of the household appliance, in particular the cooking appliance.

These objectives have been achieved by the rotary knob as defined in claim 1, the household appliance as defined in claim 10, and the control method as defined in claim 14. Further achievements have been attained by the subject-matters respectively defined in the dependent claims.

The illuminated releasable rotary knob of the present invention comprises a collar which is made from a transparent material. The collar is circumferentially disposed onto the non-transparent handle of the knob so as face the user. The collar receives the illumination from the cavity which is illuminated by the illuminating device inside the knob. The handle, the hub, the illuminating device including an electrical power supply connector, the indicator, and the collar are adapted for releasable installation onto the panel of the appliance entirely from the outside.

The household appliance of the present invention comprises one or more illuminated releasable rotary knobs. The control unit of the appliance is further adapted to control the illuminating device of each knob. The panel, each regulator shaft and each counterpart electrical power supply connection is adapted for releasable installation of the respective knob entirely from the outside of the appliance.

The control method of the present invention comprises a step of monitoring whether any knob is rotated; and a step of concurrently starting illuminating each knob that has been turned ON with a first colored light and each knob that has been turned OFF with a second colored light which is different from the first colored light when the monitoring result is affirmative.

A major advantageous effect of the present invention is that both the indicator and the collar can be illuminated by the illuminating device of the rotary knob immediately via the cavity. Thereby, the user can more easily and reliably ascertain the current operative state of the respective regulator shaft e.g. the heating unit. For instance, if the user fails to see the illuminated indicator due to an unfavorable view point, a reduced sight, or bad ambient light conditions then the illuminated collar will easily attract the attention of the user. Thereby, the user can be protected from being misled and is prompted to take a closer look at the position of the illuminated indicator. Thereby, also the risk of fire and explosion can be eliminated or reduced as much as possible. Another major advantageous effect of the present invention is that the indicator and the collar can be more intensively illuminated as the illuminating device is located in front of the panel. Another major advantageous effect of the present invention is that the complete knob including the illuminating device can be easily removed from the panel or reinstalled onto the panel entirely from the outside for maintenance, particularly for cleaning or replacement. Thereby, the customer satisfaction can be increased.

In an embodiment, the illuminating device selectively illuminates based on the rotation of hub, the cavity with one of at least two different colored lights. This embodiment is particularly advantageous as the user can be effectively informed about the operative state of the respective heating unit with two or more different colors. In another embodiment, these colors include red and blue. In another embodiment, the knob is illuminated with red light when it is ON, and the knob is illuminated with blue light when it is OFF. In another embodiment, the illuminating device includes its own detection unit for detecting any rotation of the hub. This embodiment is particularly advantageous as the service person can releasably uninstall the knob, including the detection unit entirely from the outside of the panel for maintenance. In an alternative embodiment, the detection unit is arranged into the appliance in close proximity to the hub of the knob. In other alternative embodiments, the detection unit comprises a switch or a rotary encoder.

In another embodiment, each electrical connection can also transmit/receive signals. In this embodiment, the illuminating device transmits the detection result to the control unit of the appliance. This embodiment is particularly advantageous as the control unit of the appliance can smartly perform control of each illuminating device.

In another embodiment, the illuminating device has a plurality of light sources for emitting different colored light, which are alternately disposed around the rotational axis. This embodiment is particularly advantageous as the light sources can almost uniformly illuminate the cavity. In another alternative embodiment, the illuminating device has light sources which can vary the color of the emitted light. In another embodiment, the light sources are provided in form of light emitting diodes.

In another embodiment, the collar is provided with one or more illuminated markings which are each located at a respective angular position and indicates a corresponding adjustment of the regulator shaft. This embodiment is particularly advantageous as the collar, including the illuminated markings can inform in more detail the user about the operative state of the respective heating unit. The illuminated markings may be produced by photolithography. In other alternative embodiments, the markings are provided in form of numbers, letters, or a signs. In another embodiment, the markings indicate the temperate levels of the heating unit.

In another embodiment, illuminating device is releasably held through a separate holder and protected through a transparent cover which releasably engages with the holder and which uniformly spreads the illumination into the cavity. This embodiment is particularly advantageous as the illumination device can be effectively protected without considerable reduction of the illumination.

In another embodiment, a plurality of notches and ribs are regularly formed into the protective cover. This embodiment is particularly advantageous as the notches and the ribs uniformly spread the illumination towards the indicator and the collar.

In another embodiment, the knob is supported by a separate base that can be releasably secured directly onto the panel entirely from the outside. In this embodiment, the base releasably accommodates the holder, the illuminating device and protective cover securely in place. In addition, the handle, the hub, the indicator and the collar are rotatably disposed into the gap of the base. This embodiment is particularly advantageous as the service person can more flexibly remove or reinstall the knob.

In other alternative embodiments, the household appliance is provided as a free standing or built-in type cooking appliance which has a cooking chamber and/or a cooking top. The cooking chamber and the cooking top may be provided with gas burners and/or electric heaters which are linked to the rotary knobs via the respective regulator shafts.

In another embodiment, the control unit of the appliance concurrently starts illuminating each rotary knob that has been turned ON with a first colored light and each rotary knob that has been turned OFF with a second colored light when any rotary knob is rotated.

In another embodiment, the control unit of the appliance terminates illuminating all rotary knobs when a predetermined time has elapsed from the respective start. In this embodiment, the control unit restarts illuminating each rotary knob that has been turned ON with the first colored light and each rotary knob that has been turned OFF with the second colored light when any rotary knob is rotated again. This embodiment is particularly advantageous as the energy efficiency of the appliance can be improved.

Figure 2:
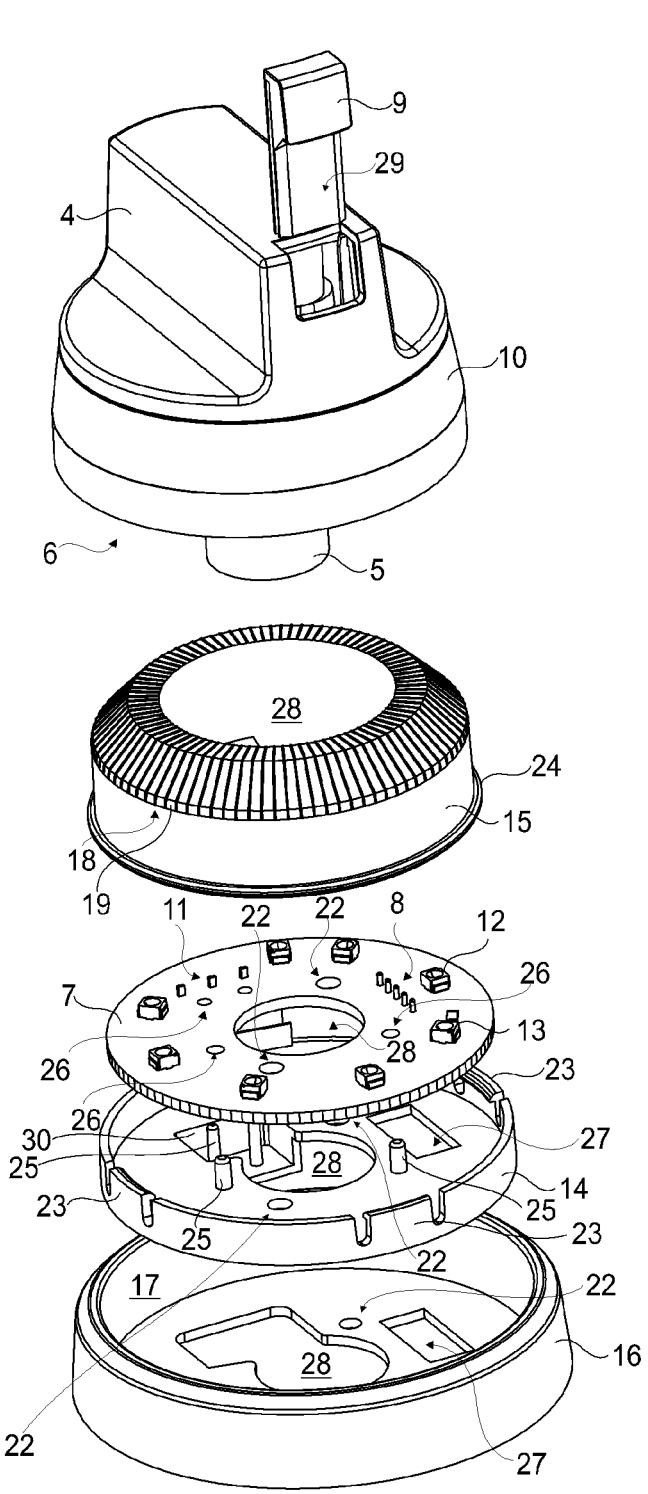
Figure 3:
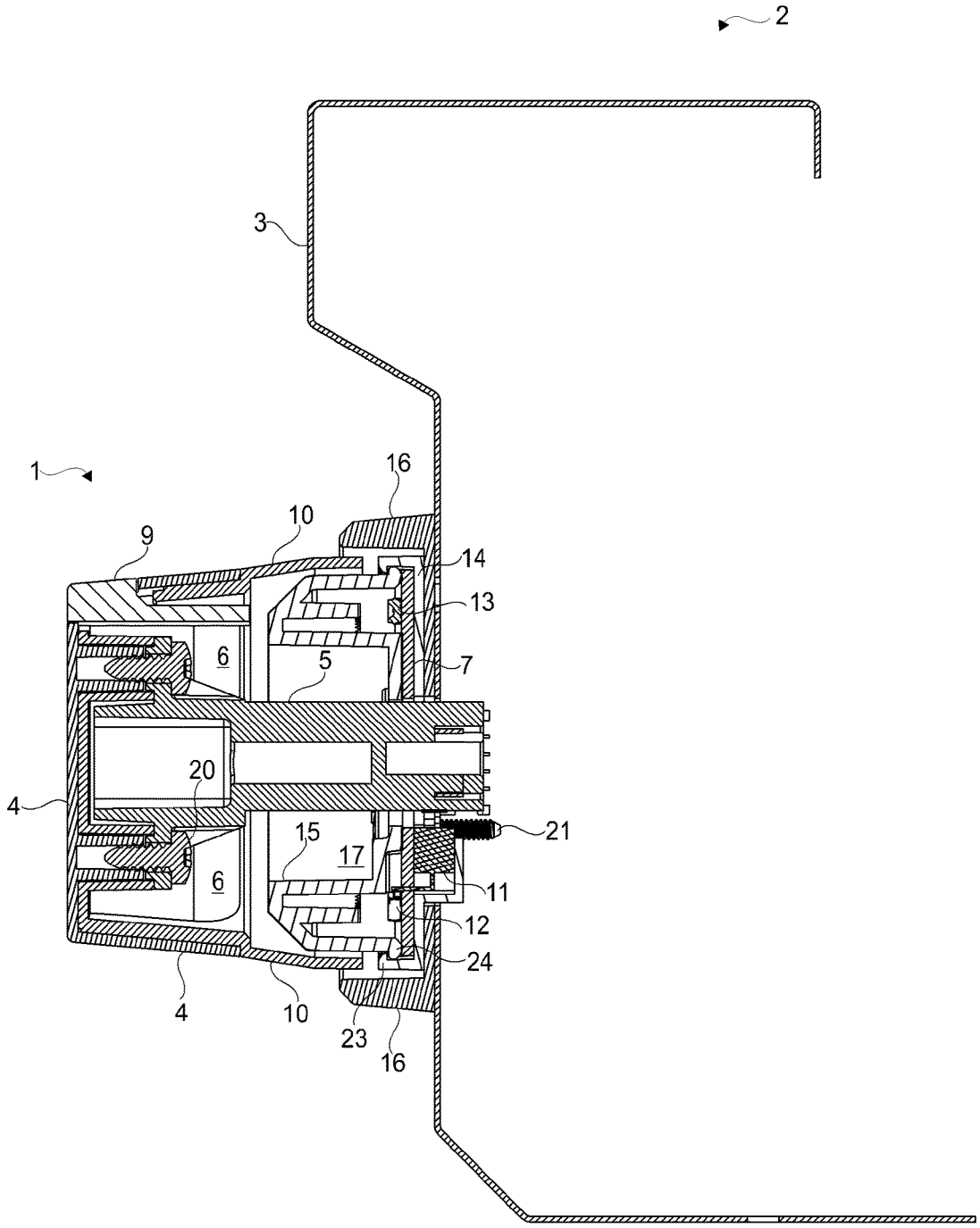
Figure 4:
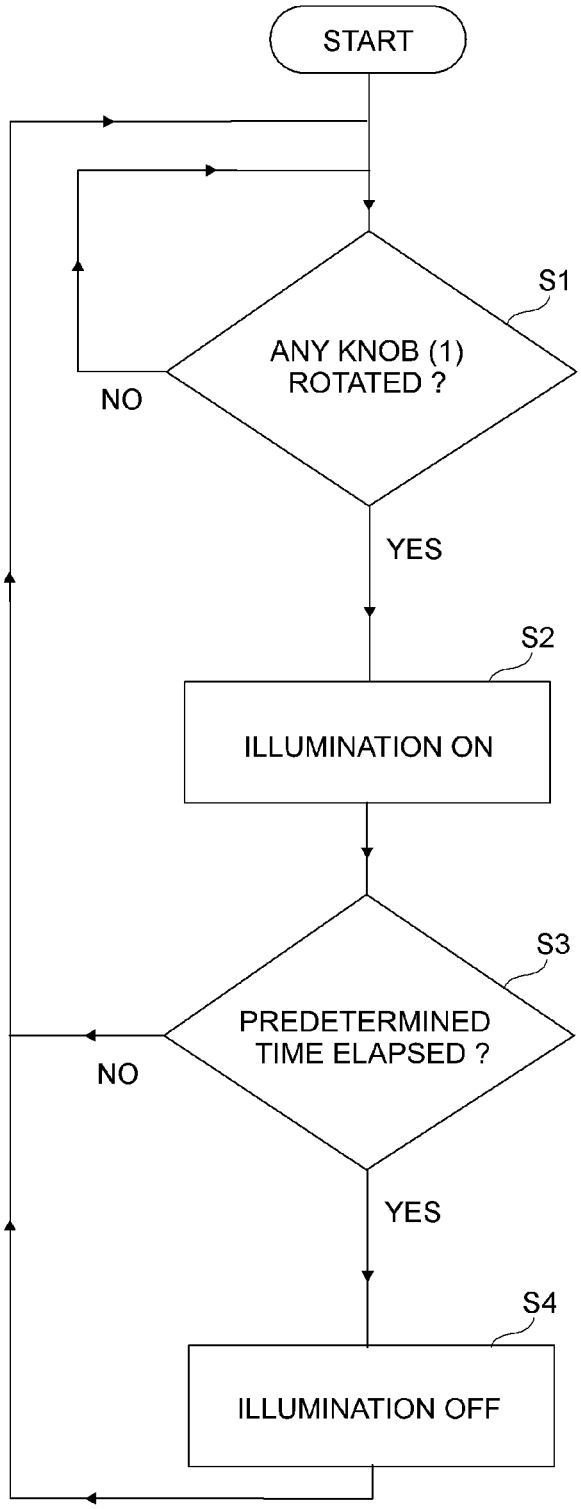

Additional features and additional advantageous effects of the rotary knob and the household appliance of the present invention will become more apparent with the detailed description of the embodiments with reference to the accompanying drawings in which:

FIG. 1—is a schematic partial front view of a household appliance which has an illuminated releasable rotary knob according to an embodiment of the present invention;

FIG. 2—is a schematic exploded view of the illuminated releasable rotary knob according to an embodiment of the present invention;

FIG. 3—is a schematic sectional view of the household appliance of FIG. 1, taken along the line A-A;

FIG. 4—is a flowchart showing the steps of a method for controlling the illuminated releasable rotary knob or the household appliance according to an embodiment of the present invention.

The reference signs appearing on the drawings relate to the following technical features.

1. Rotary knob
2. Household appliance
3. Panel
4. Handle
5. Hub
6. Cavity
7. Illuminating device
8. Connector
9. Indicator
10. Collar
11. Detection unit
12. Light source
13. Light source
14. Holder
15. Cover
16. Base
17. Depression
18. Notch
19. Rib
20. Screw
21. Screw
22. Hole
23. Hook
24. Rim
25. Pin
26. Opening
27. Aperture
28. Gap
29. Slot
30. Receptacle The illuminated releasable rotary knob (1) is suitable for use in a household appliance (2), in particular a cooking appliance.

The household appliance (2) comprises a panel (3) which includes one or more regulator shafts (not shown) each adapted to releasably receive the respective rotary knob (1); and a control unit (not shown) which has one or more electrical connections (not shown) each adapted to supply the respective rotary knob (1) with electric power.

The rotary knob (1) comprises a non-transparent rotary handle (4) which has a hub (5) adapted to releasably receive the respective regulator shaft; a cavity (6), an illuminating device (7) adapted to illuminate the cavity (6), wherein the illuminating device (7) includes a connector (8) for receiving the respective electrical connection of the appliance (2) and an indicator (9) which is made from a transparent (light conductive) material, wherein the indicator (9) is eccentrically disposed onto the handle (4) so as to face the user and adapted to receive the illumination from the cavity (6).

The rotary knob (1) of the present invention comprises a collar (10) which is made from a transparent material, wherein the collar (10) is circumferentially disposed onto the handle (4) so as face the user and adapted to receive the illumination from the cavity (6), wherein the handle (4), the hub (5), the illuminating device (7) including the connector (8), the indicator (9), and the collar (10) are adapted for releasable installation onto the panel (3) entirely from the outside.

The household appliance (2) of the present invention comprises one or more rotary knobs (1), wherein the control unit is further adapted to control the illuminating device (7) of each rotary knob (1), and wherein the panel (3), each regulator shaft and each electrical connection is adapted for releasable installation of the respective rotary knob (1) entirely from the outside.

In an embodiment, the illuminating device (7) includes a detection unit (11) adapted to detect the rotation of the hub (5). In this embodiment, the illuminating device (7) is adapted to selectively illuminate based on the detection result of the detection unit (11) the cavity (6) with one of a plurality of different colored lights which include at least a first colored light and a second colored light which is different from the first colored light.

In another embodiment, the first colored light is red and the second colored light is blue.

In another embodiment, each electrical connection is further adapted to transmit/receive signals. In this embodiment, the illuminating device (7) is further adapted to transmit the detection result via the connector (8) and the respective electrical connection to the control unit of the appliance (2).

In another embodiment, the illuminating device (7) includes two or more light sources (12) such as LED (Light Emitting Diode) of the first color and two or more light sources (13) such as LED of the second color which are alternately disposed around the rotational axis.

In another embodiment, the collar (10) is covered by a non-transparent layer (not shown) except for one or more areas (not shown) on its circumference. In this embodiment, each area is located at a respective angular position and defines a respective marking (not shown) that is indicative of a corresponding adjustment of the respective regulator shaft.

In another embodiment, one or more markings are each provided in form of a number (not shown) that indicates a corresponding temperature value.

In another embodiment, the rotary knob (1) comprises: a separate holder (14) adapted to releasably hold the illuminating device (7); and a separate ring-shaped electrically insulating protective cover (15) which is made from a transparent (light conductive) material, wherein the cover (15) is adapted for releasable engagement with the holder (14) with the illuminating device (7) being held therebetween and to substantially uniformly spread the illumination into the cavity (6).

In another embodiment, the rotary knob (1) further comprises a separate base (16) adapted for releasable installation directly onto the panel (3) entirely from the outside. In this embodiment, the holder (14) is further adapted for releasable accommodation within a depression (17) of the base (16). In this embodiment, the cover (15) is also adapted for accommodation within the depression (17) of the base (16) at a position above the illuminating device (7).

In another embodiment, the ring-shaped electrically insulating protective cover (15) comprises a plurality of regularly alternating notches (18) and ribs (19) for uniformly spreading the illumination into the cavity (6).

In another embodiment, the control unit is further adapted to receive via each electrical connection the detection result that is output by the respective illuminating device (7), and to concurrently start illuminating each rotary knob (1) that has been turned ON with a first colored light and each rotary knob (1) that has been turned OFF with a second colored light which is different from the first colored light when any rotary knob (1) is rotated.

In another embodiment, the control unit is further adapted to terminate illuminating all rotary knobs (1) when a predetermined time has elapsed from the respective start. In this embodiment, the control unit is further adapted to restart illuminating each rotary knob (1) that has been turned ON with a first colored light and each rotary knob (1) that has been turned OFF with a second colored light when any rotary knob (1) is rotated again.

In other alternative embodiments, the household appliance (2) is provided as a free standing or built-in type cooking appliance which comprises a cooking chamber (not shown) and/or a cooking top (not shown), wherein the cooking chamber and the cooking top each has one or more heating units (not shown), wherein each heating unit is provided as a gas burner (not shown), an electric heater (no shown), or an induction heater (not shown), and wherein each heating unit is linked to a respective regulator shaft that has a respective rotary knob (1).

In another embodiment, the hub (5) is provided separately from the handle (4) and the collar (10). In this embodiment, the hub (5) is attached to the handle (4) by means of screws (20). In this embodiment, the collar (10) is detachably clamped between the handle (4) and the hub (5).

In another embodiment, the base (16), the holder (14), the illuminating device (7) have mutually coinciding holes (22) for jointly receiving a respective screw (21) that is to be screwed from the outside into a respective counterpart hole (not shown) on the panel (3).

In another embodiment, the holder (14) has one or more snapping hooks (23) which releasably engage with the rim (24) of the cover (15).

In another embodiment, the holder (14) has one or more positioning and alignment pins (25). In this embodiment, the illuminating device (7) has one or more counterpart openings (26) which receive the respective pin (25).

In another embodiment, the base (16) and the holder (14) have mutually coinciding apertures (27) for receiving the respective electrical connection of the appliance (2) that is detachably attachable to the connector (8). In this embodiment, each electrical connection protrudes sufficiently beyond the panel (3) through a respective counterpart aperture (not shown) thereof so as to be attached to or unattached from the respective connector (8) from the outside.

In another embodiment, the base (16), the holder (14), the illuminating device (7) and the cover (15) have mutually coinciding gaps (28) for receiving the hub (5) and the respective regulator shaft from the outside.

In another embodiment, the handle (4) has a slot (29) which form-fittingly receives the illuminated indicator (9).

In another embodiment, the illuminating device (7) is provided in form of a printed circuit board.

In another embodiment, the detection unit (11) and the connector (8) are disposed onto the lower side of printed circuit board whereas the light sources (12, 13) are disposed onto the upper side of the printed circuit board.

In another embodiment, the holder (14) has a receptacle (30) for accommodating the detection unit (11). In this embodiment, the bottom of the receptacle (30) interlocks with the gap (28) of the base (16).

In another embodiment, the detection unit (11) is secured in place by one or more pins (25) of the holder (14).

In another embodiment, that base (16) is produced from a suitable metal material. And the handle (4), the hub (5), the indicator (9), the collar (10), the holder (14), and the cover (15) are produced from a suitable plastic material.

The control method of the present invention comprises a step (S1) of monitoring whether any rotary knob (1) is rotated; and a step (S2, S3) of concurrently starting illuminating each rotary knob (1) that has been turned ON with a first colored light and each rotary knob (1) that has been turned OFF with a second colored light which is different from the first colored light when the monitoring result is affirmative.

In another embodiment, the control method further comprises: a step (S4) of terminating illumination of all rotary knobs (1) in the illuminating step (S2,S3) when a predetermined time has elapsed from the respective start, wherein the illuminating step (S2,S3) is started over when the monitoring result is again affirmative.

A major advantageous effect of the present invention is that both the indicator (9) and the collar (10) can be illuminated by the illuminating device (7) of the rotary knob (1) via the cavity (6). Thereby, the user can more easily and reliably ascertain the current operative state of the respective regulator shaft e.g. the heating unit (not shown). For instance, if the user fails to see the illuminated indicator (9) due to an unfavorable view point, a reduced sight, or bad ambient light conditions then the illuminated collar (10) will easily attract the attention of the user. Thereby, the user can be protected from being misled and is prompted to take a closer look at the position of the illuminated indicator (9). Thereby, also the risk of fire and explosion can be eliminated or reduced as much as possible. Another major advantageous effect of the present invention is that the indicator (9) and the collar (10) can be more intensively illuminated as the illuminating device (7) is located in front of the panel (3). Another major advantageous effect of the present invention is that the complete knob (1) including the illuminating device (7) can be removed from the panel (3) or reinstalled onto the panel (3) entirely from the outside for maintenance, particularly for cleaning or replacement. Thereby, the customer satisfaction can be increased. Other advantageous effects of the present invention can be taken from the aforementioned particular embodiments.

The invention claimed is:

1. A rotary knob for use in a household appliance, the household appliance comprising a panel which includes one or more regulator shafts, and the household appliance comprising a control unit, the rotary knob comprising:

a non-transparent handle which has a hub adapted to releasably receive a respective regulator shaft;

a cavity;

an illuminating device adapted to illuminate the cavity, wherein the illuminating device includes a connector for receiving electrical power from the control unit;

an indicator which is made from a transparent material, wherein the indicator is eccentrically disposed onto the non-transparent handle so as to face a user and adapted to receive illumination from the cavity; and a collar which is made from a transparent material, wherein the collar is circumferentially disposed onto the non-transparent handle so as face the user and adapted to receive the illumination from the cavity, wherein the non-transparent handle, the hub, the illuminating device including the connector, the indicator, and the collar are adapted for releasable installation onto the panel entirely from the outside.

2. The rotary knob according to claim 1, wherein the illuminating device comprises a detection unit adapted to detect the rotation of the hub, wherein the illuminating device is adapted to selectively illuminate based on a detection result of the detection unit the cavity with one of a plurality of different colored lights which include at least a first colored light and a second colored light which is different from the first colored light.

3. The rotary knob according to claim 2, wherein the illuminating device is further adapted to transmit the detection result via the connector to the control unit.

4. The rotary knob according to claim 3, wherein the illuminating device includes two or more light sources of the first colored light and two or more light sources of the second colored light which are alternately disposed around a rotational axis.

5. The rotary knob according to claim 1, wherein the collar is covered by a non-transparent layer except for one or more areas on its circumference, wherein each of the one or more areas is located at a respective angular position and defines a respective marking that is indicative of a corresponding adjustment of the respective regulator shaft.

6. The rotary knob according to claim 5, wherein one or more markings are each provided in the form of a number that indicates a corresponding temperature value.

7. The rotary knob according to claim 1, further comprising:

a holder adapted to releasably hold the illuminating device; and a ring-shaped electrically insulating protective cover which is made from a transparent material, wherein the protective cover is adapted for releasable engagement with the holder with the illuminating device being held therebetween and to substantially uniformly spread the illumination into the cavity.

8. The rotary knob according to claim 7, further comprising:

a base adapted for releasable installation directly onto the panel entirely from the outside, wherein the holder is further adapted for releasable accommodation within a depression of the base and wherein the protective cover is also adapted for accommodation within the depression of the base at a position above the illuminating device.

9. The rotary knob according to claim 7, wherein the ring-shaped electrically insulating protective cover comprises a plurality of regularly alternating notches and ribs for uniformly spreading the illumination into the cavity.

10. A household appliance, in particular a cooking appliance comprising:

a panel which includes:

one or more regulator shafts, and a control unit adapted to supply electric power; and one or more illuminated releasable rotary knobs each as defined in claim 1, wherein the control unit is further adapted to control a respective illuminating device of each of the one or more rotary knobs, and wherein each regulator shaft is adapted for releasable installation of a respective rotary knob entirely from the outside.

11. The household appliance according to claim 10, wherein the control unit is further adapted to receive a detection result that is output by the illuminating device, and to concurrently start illuminating each rotary knob that has been turned ON with a first colored light and each rotary knob that has been turned OFF with a second colored light which is different from the first colored light when any rotary knob is rotated.

12. The household appliance according to claim 11, wherein the control unit is further adapted to terminate illuminating all rotary knobs when a predetermined time has elapsed since starting illuminating, wherein the control unit is further adapted to restart illuminating each rotary knob that has been turned ON with the first colored light and each rotary knob that has been turned OFF with the second colored light when any rotary knob is rotated again.

13. The household appliance according to claim 10, wherein the household appliance is provided as a free standing or built-in type cooking appliance which comprises a cooking chamber or a cooking top, wherein the cooking chamber and the cooking top each has one or more heating units, and wherein each heating unit is provided as a gas burner or an electric heater, wherein each heating unit is linked to a respective regulator shaft.

14. A method for controlling one or more rotary knobs each as defined in claim 1, the method comprising:

monitoring whether any rotary knob is rotated; and concurrently starting illuminating each rotary knob that has been turned ON with a first colored light and each rotary knob that has been turned OFF with a second colored light which is different from the first colored light when at least one rotary knob is rotated.

15. The method according to claim 14, further comprising:

terminating illumination of all rotary knobs in when a predetermined time has elapsed since starting illuminating, wherein illuminating is started over when the at least one rotary knob is again rotated.

* * * * *